US010126700B2

(12) United States Patent
Koyanagi

(10) Patent No.: US 10,126,700 B2
(45) Date of Patent: Nov. 13, 2018

(54) IMAGE FORMING APPARATUS WITH COUPLING MEMBER HAVING TWO ROTATION PIVOTS

(71) Applicant: KYOCERA Document Solutions Inc., Osaka (JP)

(72) Inventor: Tsuyoshi Koyanagi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/416,685

(22) Filed: Jan. 26, 2017

(65) Prior Publication Data

US 2017/0242391 A1 Aug. 24, 2017

(30) Foreign Application Priority Data

Feb. 18, 2016 (JP) ..... 2016-028831

(51) Int. Cl.
*G03G 21/16* (2006.01)

(52) U.S. Cl.
CPC ..... *G03G 21/1633* (2013.01)

(58) Field of Classification Search
CPC ..... G03G 21/1633
See application file for complete search history.

(56) References Cited

U.S. PATENT DOCUMENTS 6,233,426 B1 * 5/2001 Lee ..... G03G 15/605 355/75
7,747,208 B2 * 6/2010 Sheng ..... H04N 1/00519 358/305
2003/0170047 A1 * 9/2003 Yoshida ..... G03G 15/50 399/110
2005/0042006 A1 * 2/2005 Qian ..... H04N 1/00519 399/380
2006/0088336 A1 * 4/2006 Hirose ..... G03G 15/60 399/110
2006/0280533 A1 * 12/2006 Ozawa ..... G03G 15/6558 399/361

(Continued)

FOREIGN PATENT DOCUMENTS

JP 09068913 A * 3/1997
JP S 64-065899 A 3/1999

(Continued)

OTHER PUBLICATIONS

Machine translation of Arimitsu (1997).*

*Primary Examiner* — Sevan A Aydin
(74) *Attorney, Agent, or Firm* — Stein IP, LLC

(57) ABSTRACT

An image forming apparatus has an apparatus main body, a cover member, and a coupling member. The cover member is openable and closable relative to a side face of the apparatus main body. The coupling member couples the apparatus main body and the cover member together and is arranged inside the cover member when the cover member is closed. The coupling member is rotatable about a first rotation pivot relative to the apparatus main body. The cover member is rotatable about a second rotation pivot relative to the coupling member. When the cover member is opened relative to the apparatus main body, the rotation center of the cover member switches between the first and second rotation pivots during the opening operation of the cover member.

6 Claims, 6 Drawing Sheets

(56) References Cited

U.S. PATENT DOCUMENTS

| | | | | |
|---|---|---|---|---|
| 2010/0067941 | A1* | 3/2010 | Inui | G03G 21/1633 399/107 |
| 2011/0211223 | A1* | 9/2011 | Ito | G03G 15/60 358/1.15 |
| 2012/0155916 | A1* | 6/2012 | Ito | B41J 29/02 399/110 |
| 2014/0248066 | A1* | 9/2014 | Akiyama | G03G 21/1633 399/107 |
| 2015/0307311 | A1* | 10/2015 | Ono | B65H 31/02 271/176 |
| 2015/0309469 | A1* | 10/2015 | Kusano | G03G 21/1633 399/110 |
| 2016/0124381 | A1* | 5/2016 | Nakao | G03G 21/1633 399/110 |

FOREIGN PATENT DOCUMENTS

| | | | | |
|---|---|---|---|---|
| JP | 2007-33706 | A | | 2/2007 |
| JP | 2010-191117 | A | | 9/2010 |
| JP | 2014017298 | A | * | 1/2014 |
| JP | 2014-56086 | A | | 3/2014 |
| JP | 2014-170117 | A | | 9/2014 |
| JP | 2015018122 | A | * | 1/2015 |
| WO | WO 2014/091616 | A1 | | 6/2014 |

* cited by examiner

IMAGE FORMING APPARATUS WITH COUPLING MEMBER HAVING TWO ROTATION PIVOTS

INCORPORATION BY REFERENCE

This application is based upon and claims the benefit of priority from the corresponding Japanese Patent Application No. 2016-028831 filed on Feb. 18, 2016, the entire contents of which are incorporated herein by reference.

BACKGROUND

The present disclosure relates to image forming apparatuses such as copiers, printers, and facsimile machines. More particularly, the present disclosure relates to image forming apparatuses provided with a cover member that is openable and closable relative to a side face of the apparatus main body.

Conventionally, image forming apparatuses provided with a cover member that is openable and closable relative to a side face of the apparatus main body are known. Such a cover member is arranged, for example, so as to cover the front-face side of a waste toner bottle for collecting toner left unused for development, and opens and closes like a hinged door about one rotation pivot extending in the up/down direction.

SUMMARY

According to one aspect of the present disclosure, an image forming apparatus is provided with an apparatus main body, a cover member, and a coupling member. The cover member is openable and closable relative to a side face of the apparatus main body. The coupling member couples the apparatus main body and the cover member together and is arranged inside the cover member when the cover member is closed. The coupling member is rotatable about a first rotation pivot relative to the apparatus main body, and the cover member is rotatable about a second rotation pivot relative to the coupling member. When the cover member is opened relative to the apparatus main body, the rotation center of the cover member switches between the first and second rotation pivots during the opening operation of the cover member.

Further features and advantages of the present disclosure will become apparent from the description of embodiments given below.

DETAILED DESCRIPTION

An embodiment of the present disclosure will be described below with reference to the accompanying drawings.

With reference to FIGS. 1 to 10, an image forming apparatus 10 such as a copier according to an embodiment of the present disclosure and a post-processing device 50 to which sheets having undergone image formation are conveyed from the image forming apparatus 10 will be described.

Figure 1:
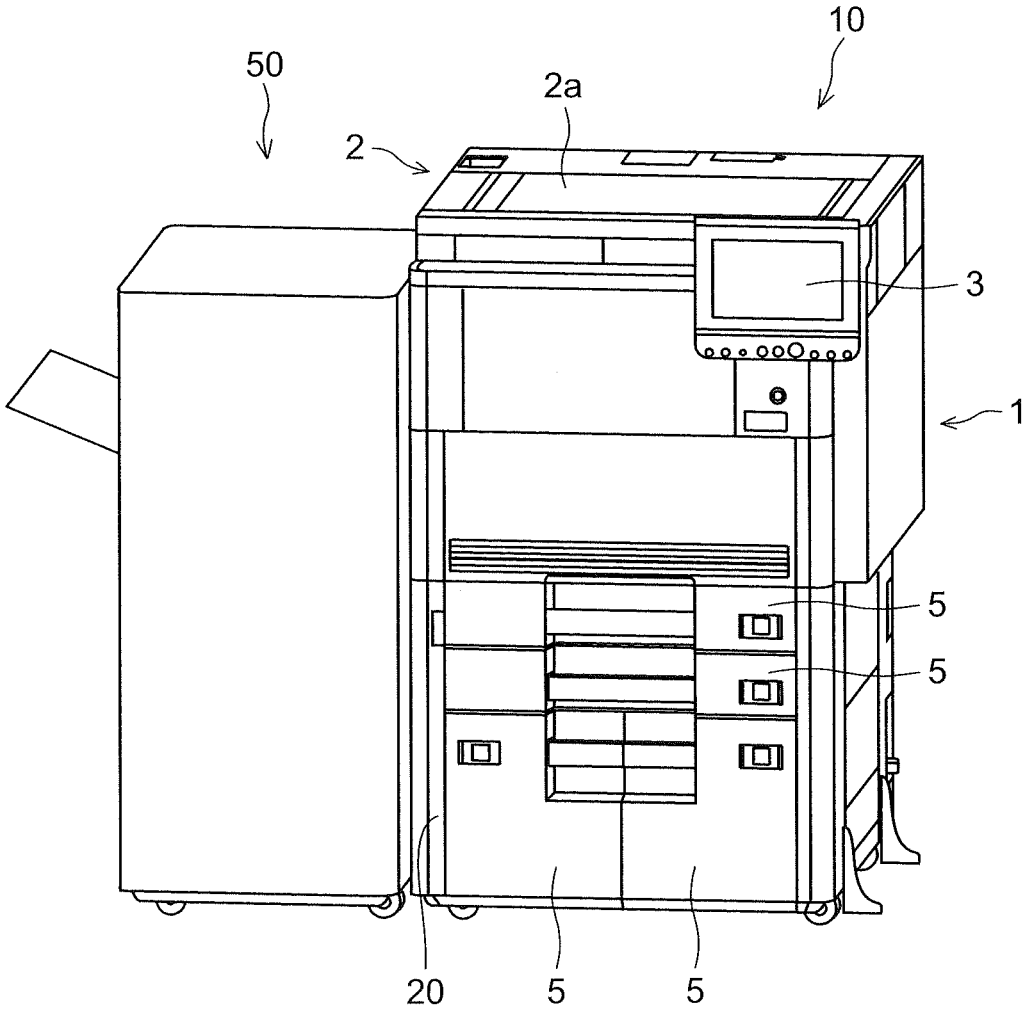
FIG. 1 is an exterior perspective view of an image forming apparatus and a post-processing apparatus according to an embodiment of the present disclosure.

As shown in FIG. 1, the image forming apparatus 10 is provided with an apparatus main body (image forming apparatus main body) 1 and an image reading device 2 arranged over it. Inside the image reading device 2, an image reading section which reads image information of a document on a contact glass 2*a* is provided. The image reading section is composed of a scanning optical system incorporating a scanner lamp which illuminates a document during copying and a mirror which changes the optical path of the reflected light from the document, a converging lens which converges and focuses the reflected light from the document, a CCD sensor which converts the focused image light into an electrical signal, and the like (none of these are illustrated), and reads a document image and converts it into image data.

In a front part of the image reading device 2, an operation panel 3 having operation buttons and a display is provided. In an upper part of the image reading device 2, a platen (not shown) which presses the document placed on the contact glass 2*a* is provided so as to be openable and closable. On the platen, an automatic document conveying device (not shown) which automatically feeds one sheet after another out of a bunch of document sheets onto the contact glass 2*a* may be provided.

In a front part of the apparatus main body 1, a plurality of sheet feed cassettes 5 in which sheets are stored are provided so as to be attachable to and detachable from the apparatus main body 1.

Inside the apparatus main body 1, there are provided an image forming section, a fixing section, a sheet conveying section, and the like, of which none are illustrated. The image forming section forms an image by transferring a toner image to a sheet fed to it based on image data read by the image reading device 2. The image forming section includes a photosensitive drum which carries an electrostatic latent image, a charging unit which electrostatically charges the surface of the photosensitive drum, an exposure unit which forms an electrostatic latent image corresponding to a document image on the surface of the photosensitive drum with a laser beam or the like, a developing unit which forms a toner image by attaching developer to the formed electrostatic latent image, a transfer roller which transfers the toner image to the sheet, a cleaning blade which removes residual toner on the surface of the photosensitive drum, and the like. The fixing section fixes the toner image on the sheet by applying heat and pressure to the sheet having the toner image transferred to it. The sheet conveying section extends upward along the right side face of the apparatus main body 1, and conveys the sheet from a sheet feed cassette 5 to the image forming section.

In a lower left part of a front part of the apparatus main body 1, a cover member 20 which opens and closes like a hinged door relative to the apparatus main body 1 is fitted. The cover member 20 is provided so as to cover the front-face side of a waste toner bottle (not shown) which collects toner that is left unused for development.

The post-processing device 50 is coupled to a downstream-side (left side in FIG. 1) side part of the image forming apparatus 10 in the sheet conveying direction, and sheets having images formed on them are conveyed from the image forming apparatus 10 to the post-processing device 50. The post-processing device 50 performs post-processing, such as punch hole forming processing and binding processing, on sheets having undergone an image forming process in the image forming apparatus 10.

Next, the structure of and around the cover member 20 will be described.

Figure 2:
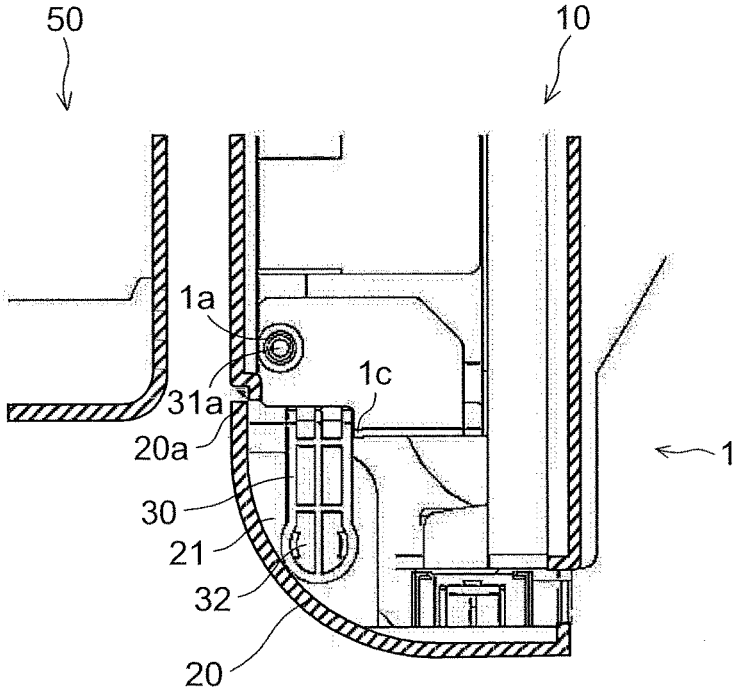
FIG. 2 is a sectional view showing a structure around a cover member in the image forming apparatus according to the embodiment as seen from above, showing a state where the cover member is closed.
Figure 3:
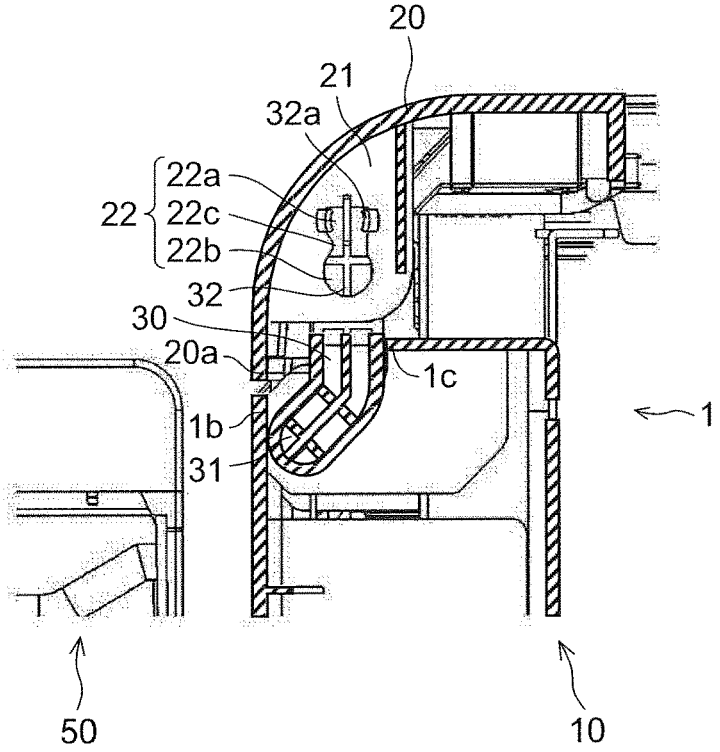
FIG. 3 is a sectional view showing the structure around the cover member in the image forming apparatus according to the embodiment as seen from below, showing the state where the cover member is closed.

The cover member 20 is provided so as to be openable and closable in the horizontal direction relative to a side face of the apparatus main body 1. Moreover, as shown in FIGS. 2 and 3, between the cover member 20 and the apparatus main body 1, a coupling member 30 which couples the cover member 20 and the apparatus main body 1 together is provided. The coupling member 30 is arranged inside the cover member 20 when the cover member 20 is closed (in the state in FIGS. 2 and 3). In practice, two coupling members 30 are provided one in each of upper and lower end parts of the cover member 20; however, the following description will deal with only one of them because the structure of and around each coupling member 30 is similar.

Figure 4:
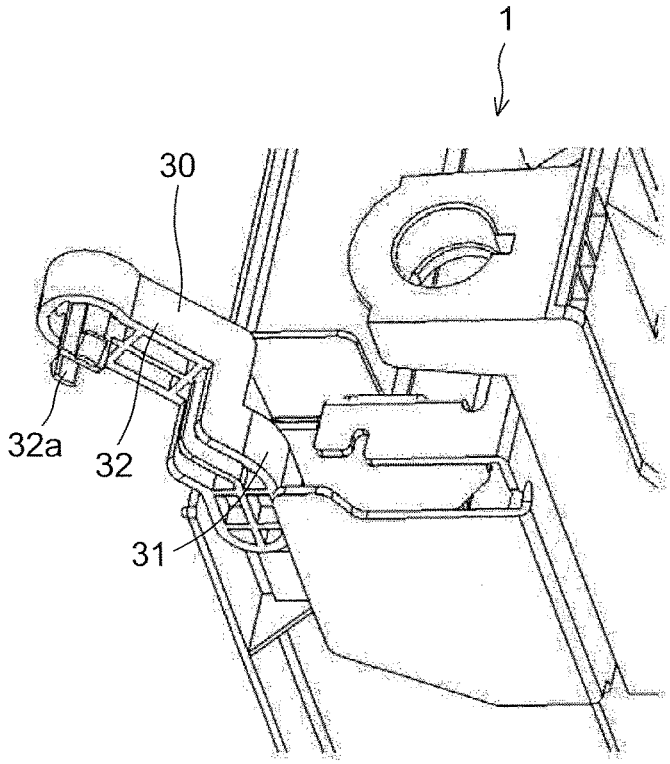
FIG. 4 is a sectional view showing a structure around a coupling member in the image forming apparatus according to the embodiment as seen from below, showing a state where the cover member is removed.

As shown in FIGS. 2 to 4, the coupling member 30 is formed in a shape bent with an obtuse angle as seen from the up/down direction, and is formed to have a step shape in the up/down direction. The coupling member 30 is made of resin, and is formed as one component. The coupling member 30 has a body-side coupling portion 31 which is coupled to the apparatus main body 1 and a cover-side coupling portion 32 which is coupled to the cover member 20. In the body-side coupling portion 31, a round-columnar first rotary shaft 31*a* (see FIG. 2) which extends upward is formed, and in the cover-side coupling portion 32, an engagement portion 32*a* (see FIG. 4) which protrudes downward and has a snap-fit structure is formed.

Figure 5:
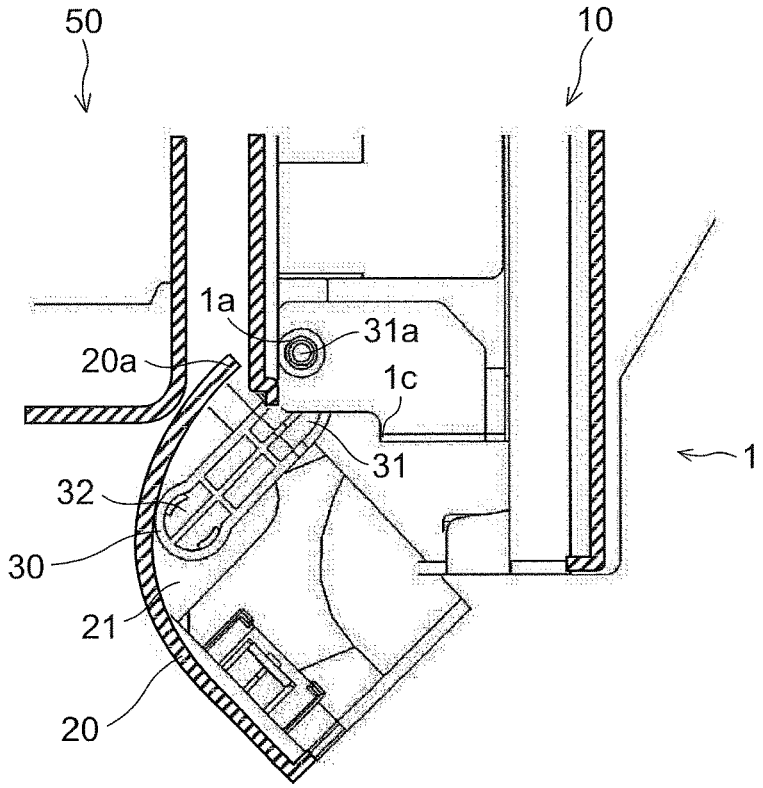
FIG. 5 is a sectional view showing the structure around the cover member in the image forming apparatus according to the embodiment as seen from above, showing the state where the cover member is halfway open.
Figure 6:
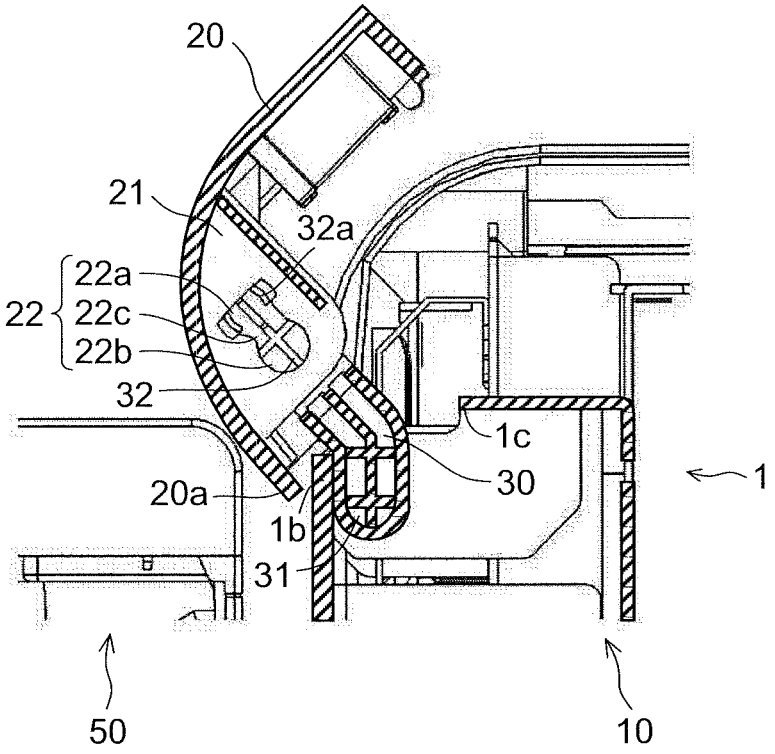
FIG. 6 is a sectional view showing the structure around the cover member in the image forming apparatus according to the embodiment as seen from below, showing the state where the cover member is halfway open.

The first rotary shaft 31*a* of the coupling member 30 is inserted in an insertion hole 1*a* (see FIG. 2) which is provided in the apparatus main body 1, and the coupling member 30 is rotatable about the first rotary shaft 31*a* as sown in FIGS. 5 and 6. The insertion hole 1*a* and the first rotary shaft 31*a* constitute a first rotation pivot according to the present disclosure.

As shown in FIG. 6, in the apparatus main body 1, a first restricting portion 1*b* which serves as a rotation stop part against the coupling member 30 in the opening operation of the cover member 20, that is, which makes contact with the coupling member 30 when the cover member 20 is open, is provided. Moreover, as shown in FIG. 3, in the apparatus main body 1, a second restricting portion 1*c* which serves as a rotation stop part against the coupling member 30 in the closing operation of the cover member 20, that is, which makes contact with the coupling member 30 when the cover member 20 is closed, is provided.

The cover member 20 constitutes a part of a front-face part, and a part of a left side part, of the apparatus main body 1. That is, the cover member 20 is formed to bridge between two adjacent side faces of the apparatus main body 1.

Figure 7:
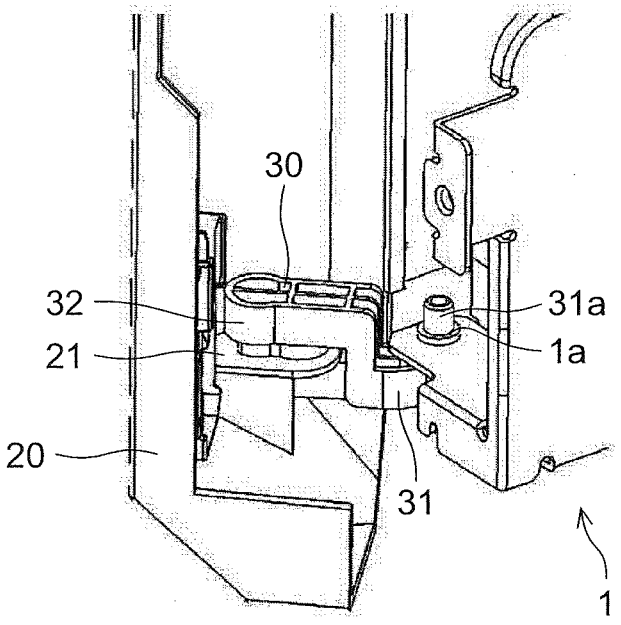
FIG. 7 is a perspective view showing the structure around the cover member in the image forming apparatus according to the embodiment as seen from above, showing the state where the cover member is halfway open.

As shown in FIGS. 5 to 7, the cover member 20 has a plate-form portion 21 which extends in the horizontal direction and an engagement hole 22 (see FIG. 6) which is provided in the plate-form portion 21 and which is engaged with the engagement portion 32*a* of the coupling member 30. The engagement hole 22 and the engagement portion 32*a* constitute a second rotation pivot according to the present disclosure.

The engagement hole 22 has a rotation limiting portion 22*a* which limits the rotation of the cover member 20 relative to the coupling member 30 and a rotating portion 22*b* which does not limit the rotation of the cover member 20 relative to the coupling member 30. Specifically, the rotation limiting portion 22*a* is formed in a shape elongate in the elasticity direction (left/right direction in FIG. 3) of the engagement portion 32*a* when the cover member 20 is closed (in the state in FIG. 3), and limits the rotation of the engagement portion 32*a* relative to the engagement hole 22. The rotating portion 22*b* is formed in a substantially circular shape, and does not limit the rotation of the engagement portion 32*a* relative to the engagement hole 22. Between the rotation limiting portion 22*a* and the rotating portion 22*b*, a narrowed portion 22*c* is formed, so that the engagement hole 22 has substantially the shape of a bottle gourd.

In an end part (upper end in FIG. 8) of an exterior surface part of the cover member 20, a restricting portion 20*a* which restricts rotation by making contact with a side face of the coupling member 30 in the opening operation of the cover member 20 is provided.

Next, the opening and closing operation of the cover member 20 will be described.

When the cover member 20 is opened relative to the apparatus main body 1 from a state where the cover member 20 is closed (the state in FIGS. 2 and 3), the coupling member 30 and the cover member 20 rotate about the first rotary shaft 31*a* relative to the apparatus main body 1. At this time, the engagement portion 32*a* of the coupling member 30 is arranged in the rotation limiting portion 22*a* of the engagement hole 22 of the cover member 20.

As shown in FIGS. 5 to 7, immediately before the cover member 20 makes contact with the post-processing device 50, the coupling member 30 makes contact with the first restricting portion 1*b* of the apparatus main body 1, and the coupling member 30 stops rotating.

Figure 8:
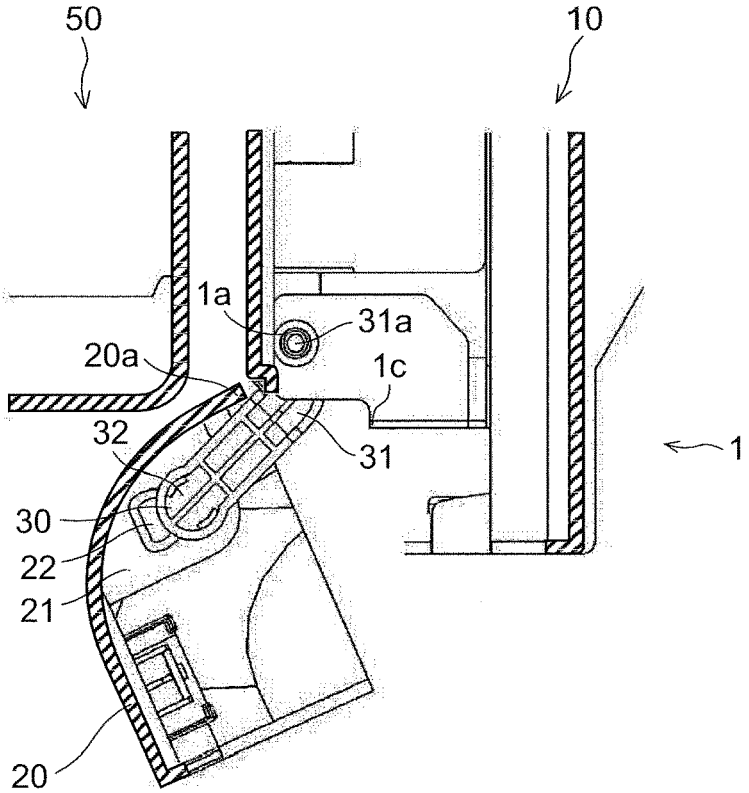
FIG. 8 is a sectional view showing the structure around the cover member in the image forming apparatus according to the embodiment as seen from above, showing the state where the cover member is maximally open.
Figure 9:
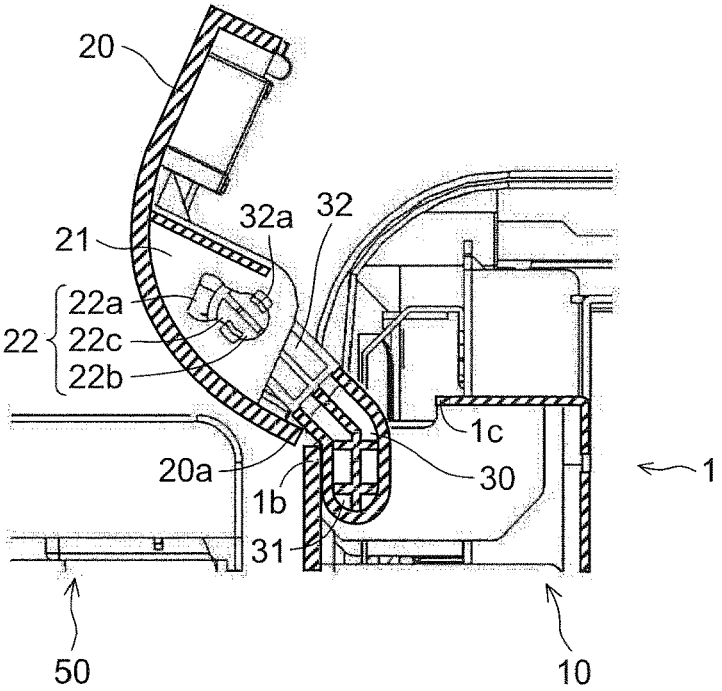
FIG. 9 is a sectional view showing the structure around the cover member in the image forming apparatus according to the embodiment as seen from below, showing the state where the cover member is maximally open.
Figure 10:
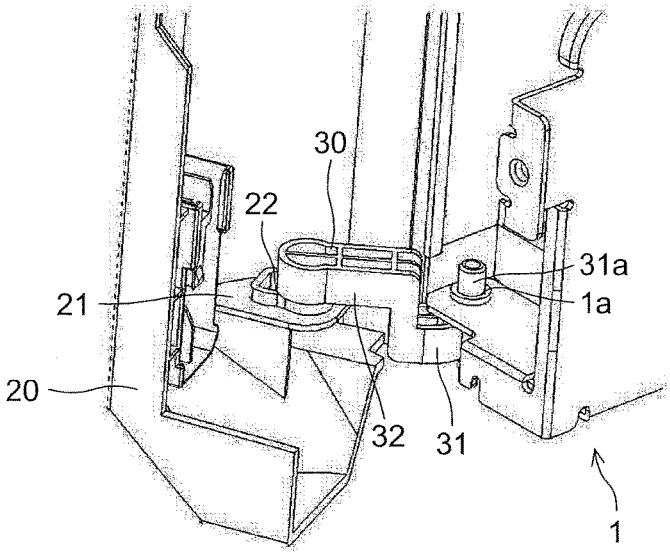
FIG. 10 is a perspective view showing the structure around the cover member in the image forming apparatus according to the embodiment as seen from above, showing the state where the cover member is maximally open.

Thereafter, the engagement portion 32*a* of the coupling member 30 moves from the rotation limiting portion 22*a* across the narrowed portion 22*c* to the rotating portion 22*b*. Thus, the rotation center of the cover member 20 switches from the first rotary shaft 31*a* to the engagement portion 32*a*, and the cover member 20 rotates about the engagement portion 32*a* relative to the coupling member 30. Then, as shown in FIGS. 8 to 10, the restricting portion 20*a* of the cover member 20 makes contact with the coupling member 30, and the opening operation of the cover member 20 ends.

On the other hand, when the cover member 20 is closed relative to the apparatus main body 1 from a state (the state in FIGS. 8 to 10) where the cover member 20 is open maximally (to the end), the cover member 20 rotates about the engagement portion 32*a* relative to the coupling member 30.

Then, as shown in FIGS. 5 to 7, the engagement portion 32*a* of the coupling member 30 moves from the rotating portion 22*b* across the narrowed portion 22*c* to the rotation limiting portion 22*a*, and the cover member 20 stops rotating relative to the coupling member 30. Thus, the rotation center of the cover member 20 switches from the engagement portion 32*a* to the first rotary shaft 31*a*.

Thereafter, the coupling member 30 and the cover member 20 rotate about the first rotary shaft 31*a* relative to the apparatus main body 1. Then, as shown in FIGS. 2 and 3, the coupling member 30 makes contact with the second restricting portion 1*c*, and the cover member 20 closes. In this way, the closing operation of the cover member 20 ends.

Incidentally, when the cover member 20 is closed relative to the apparatus main body 1 from a state (the state in FIGS. 8 to 10) where the cover member 20 is open maximally (to the end), depending on the rotation load of the coupling member 30, the coupling member 30 may rotate first about the first rotary shaft 31*a*.

In that case, the coupling member 30 and the cover member 20 rotate about the first rotary shaft 31*a*. Then, the coupling member 30 makes contact with the second restricting portion 1*c* of the apparatus main body 1, and the coupling member 30 stops rotating.

Thereafter, the engagement portion 32*a* of the coupling member 30 moves from the rotation limiting portion 22*a* across the narrowed portion 22*c* to the rotating portion 22*b*, and the rotation center of the cover member 20 switches from the first rotary shaft 31*a* to the engagement portion 32*a*.

Then, as the cover member 20 rotates about the engagement portion 32*a* relative to the coupling member 30, as shown in FIGS. 2 and 3, the cover member 20 closes. In this way, the closing operation of the cover member 20 ends.

In this embodiment, as described above, when the cover member 20 is opened relative to the apparatus main body 1, the cover member 20 and the coupling member 30 rotate about the first rotary shaft 31*a*, and immediately before the cover member 20 makes contact with the post-processing device 50, the rotation center of the cover member 20 switches from the first rotary shaft 31*a* to the engagement portion 32*a*. Then, the cover member 20 rotates further about the engagement portion 32*a*. Thus, even in a case where the post-processing device 50 is arranged outside the apparatus main body 1, the cover member 20 can be opened sufficiently.

Moreover, as described above, when the cover member 20 is opened relative to the apparatus main body 1, the engagement portion 32*a* of the coupling member 30 moves from the rotation limiting portion 22*a* of the engagement hole 22 to the rotating portion 22*b*. Thus, after the coupling member 30 and the cover member 20 have rotated about the first rotary shaft 31*a*, the cover member 20 can be rotated further easily about the engagement portion 32*a*.

Moreover, as described above, between the rotation limiting portion 22*a* and the rotating portion 22*b*, the narrowed portion 22*c* is formed. Thus, the movement of the engagement portion 32*a* from the rotation limiting portion 22*a* to the rotating portion 22*b* can be limited, and thereby the engagement portion 32*a* can be held in the rotation limiting portion 22*a* until the coupling member 30 makes contact with the first restricting portion 1*b* and a predetermined load acts on the engagement portion 32*a*.

Moreover, as described above, the engagement portion 32*a* is formed to have a snap-fit structure. Thus, the engagement portion 32*a* can be deformed elastically to pass through the narrowed portion 22*c*.

Moreover, as described above, in the apparatus main body 1, the first restricting portion 1*b* which serves as the rotation stop part against the coupling member 30 when the cover member 20 is opened relative to the apparatus main body 1 is provided. Thus, when the cover member 20 is opened relative to the apparatus main body 1, immediately before the cover member 20 makes contact with the post-processing device 50, the rotation of the coupling member 30 can be stopped.

Moreover, as described above, in the apparatus main body 1, the second restricting portion 1*c* which serves as the rotation stop part against the coupling member 30 when the cover member 20 is closed relative to the apparatus main body 1 is provided. Thus, it is possible to stop the rotation of the coupling member 30 with the second restricting portion 1*c*, switch the rotation center of the cover member 20 from the first rotary shaft 31*a* to the engagement portion 32*a*, and to close the cover member 20 easily.

Moreover, as described above, the coupling member 30 is formed as one component. Thus, it is possible to suppress an increase in the number of components, and to achieve sufficient opening of the cover member 20 with a simple structure.

It should be understood that the embodiment disclosed herein is in every aspect illustrative and not restrictive. The scope of the present disclosure is defined not by the description of the embodiment given above but by the appended claims, and encompasses any modifications made within the sense and scope equivalent to those of the claims.

For example, although an example where the present disclosure is applied to a copier has been take up above, this is not meant to limit the application of the present disclosure. Needless to say, the present disclosure is applicable to image forming apparatuses such as printers, multifunction peripherals, and facsimile machines.

Although the embodiment described above deals with an example where, when the cover member 20 is opened, first the coupling member 30 and the cover member 20 rotate about the first rotary shaft 31*a* and then the cover member 20 rotates about the engagement portion 32*a*, this is not meant to limit the present disclosure to that configuration. As an alternative, when the cover member 20 is opened, first the cover member 20 may rotate about the engagement portion 32*a* and then the coupling member 30 and the cover member 20 may rotate about the first rotary shaft 31*a*.

As another alternative, when the cover member 20 is opened, first the coupling member 30 and the cover member 20 may rotate about the first rotary shaft 31*a*, and then the cover member 20 may rotate about the engagement portion 32*a*; on the other hand, when the cover member 20 is closed, first the cover member 20 may rotate about the engagement portion 32*a* and then the coupling member 30 and the cover member 20 may rotate about the first rotary shaft 31*a*. This is easily achieved by providing a biasing member, such as a torsion spring, which biases the coupling member 30 in the opening direction (clockwise direction in FIG. 2).

What is claimed is:

1. An image forming apparatus comprising:

an apparatus main body;

a cover member openable and closable relative to a side face of the apparatus main body; and a coupling member rotatably coupling the apparatus main body and the cover member together and arranged inside the cover member when the cover member is closed, wherein the coupling member is rotatable about a first rotation pivot relative to the apparatus main body, the cover member is coupled rotatably about a second rotation pivot relative to the coupling member, the second rotation pivot being arranged parallel at a predetermined distance from the first rotation pivot, the apparatus main body has a first restricting portion making contact with and thereby stopping rotation of the coupling member about the first rotation pivot when the cover member is opened relative to the apparatus main body, the second rotation pivot is composed of an engagement portion provided on the coupling member and an engagement hole formed in the cover member and engaged with the engagement portion, the engagement hole has a rotation limiting portion limiting rotation of the cover member relative to the coupling member and a rotating portion communicating with the rotation limiting portion and not limiting rotation of the cover member relative to the coupling member, the engagement portion in a state engaged with the engagement hole is movable between the rotation limiting portion and the rotating portion, when the cover member is closed, the engagement portion is arranged in the rotation limiting portion, when the cover member is opened relative to the apparatus main body, during opening operation of the cover member, the coupling member and the cover member rotate about the first rotation pivot and then the engagement portion moves from the rotation limiting portion to the rotating portion so that a rotation center of the cover member switches from the first rotation pivot to the second rotation pivot and the cover member rotates about the second rotation pivot relative to the coupling member, and a rotation direction of the cover member about the first rotation pivot and a rotation direction of the cover member about the second rotation pivot are identical.

2. The image forming apparatus of claim 1, wherein when the cover member is opened relative to the apparatus main body, first the coupling member and the cover member rotate about the first rotation pivot in a first direction until being restricted by the first restricting portion and then the cover member rotates about the second rotation pivot in the first direction.

3. The image forming apparatus of claim 2, wherein between the rotation limiting portion and the rotating portion of the engagement hole, a narrowed portion which connects together the rotation limiting portion and the rotating portion in a second direction is formed, and a length of the narrowed portion in a third direction perpendicular to the second direction is smaller than a length of the rotation limiting portion in the third direction and a length of the rotating portion in the third direction.

4. The image forming apparatus of claim 3, wherein the engagement portion includes a pair of engagement pieces protruding from the coupling member, the engagement pieces having an engagement claw in a tip part thereof, the engagement pieces being elastically deformable in a direction perpendicular to a protruding direction.

5. The image forming apparatus of claim 2, wherein the apparatus main body has a second restricting portion making contact with and thereby stopping rotation of the coupling member about the first rotation pivot in a direction opposite to the first direction when the cover member is closed relative to the apparatus main body.

6. The image forming apparatus of claim 1, wherein the coupling member is formed as a unitary component.

* * * * *